US006676127B2

(12) United States Patent
Johnson et al.

(10) Patent No.: US 6,676,127 B2
(45) Date of Patent: Jan. 13, 2004

(54) COLLATING AND SORTING APPARATUS

(75) Inventors: Rodney George Johnson, Robina (AU); Mark William Piacun, Carrara (AU)

(73) Assignee: Shuffle Master, Inc., Eden Prairie, MN (US)

( * ) Notice: Subject to any disclaimer, the term of this patent is extended or adjusted under 35 U.S.C. 154(b) by 0 days.

(21) Appl. No.: 09/919,596

(22) Filed: Jul. 31, 2001

(65) Prior Publication Data

US 2002/0017481 A1 Feb. 14, 2002

Related U.S. Application Data

(63) Continuation-in-part of application No. 09/380,943, filed on Sep. 13, 1999, now Pat. No. 6,267,248.

(30) Foreign Application Priority Data

Mar. 13, 1997 (AU) ..... P05640
Mar. 13, 1998 (WO) ..... PCT/AU98/00157

(51) Int. Cl.[7] ..... A63F 1/12
(52) U.S. Cl. ..... 273/149 R; 273/149 P
(58) Field of Search ..... 273/149 R, 149 P; 270/52.01, 52.02, 58.01, 58.18, 58.33, 58.34; 271/1, 109, 110, 111

(56) References Cited

U.S. PATENT DOCUMENTS 1,885,276 A * 11/1932 McKay ..... 273/149 R
2,001,220 A 5/1935 Smith
2,016,030 A 10/1935 Woodruff et al.
2,778,644 A 1/1957 Stephenson
2,950,005 A 8/1960 MacDonald
3,595,388 A 7/1971 Castaldi
3,897,954 A 8/1975 Erickson et al.
4,388,994 A 6/1983 Suda et al.
4,497,488 A 2/1985 Plevyak et al.
4,512,580 A * 4/1985 Matviak ..... 273/148 A
4,513,969 A 4/1985 Samsel, Jr.
4,515,367 A 5/1985 Howard
4,586,712 A * 5/1986 Lorber et al. ..... 273/149 R
4,659,082 A * 4/1987 Greenberg ..... 273/149 R
4,662,637 A * 5/1987 Pfeiffer ..... 273/149 P
4,667,959 A 5/1987 Pfeiffer et al.
4,759,448 A 7/1988 Kawabata
4,770,421 A * 9/1988 Hoffman ..... 273/149
4,876,000 A 10/1989 Mikhail
5,121,921 A 6/1992 Friedman et al.
5,356,145 A 10/1994 Verschoor
5,382,024 A 1/1995 Blaha
5,431,399 A 7/1995 Kelley
5,683,085 A 11/1997 Johnson et al.
5,944,310 A 8/1999 Johnson et al.
5,989,122 A * 11/1999 Roblejo ..... 463/22
6,149,154 A * 11/2000 Grauzer et al. ..... 273/149 R
6,213,310 B1 * 4/2001 Wennersten et al. ..... 209/534
6,250,632 B1 * 6/2001 Albrecht ..... 273/149 R
6,254,096 B1 * 7/2001 Grauzer et al. ..... 273/149 R
6,267,248 B1 7/2001 Johnson et al.

FOREIGN PATENT DOCUMENTS

WO WO-87/00764 A1 * 2/1987 ..... A63F/1/14

OTHER PUBLICATIONS

1/3" B/W CCD Camera Module EB100 by EverFocus Electronics Corp. Jul. 31, 2001, http:/www.everfocus.com/products/eb100.html.

* cited by examiner

*Primary Examiner*—Donald P. Walsh
*Assistant Examiner*—Mark J Beauchaine
(74) *Attorney, Agent, or Firm*—Mark A. Litman & Assoc. P.A.

(57) ABSTRACT

A card handling device having either a vertical stack of compartments or a carousel of compartments is used to receive individual cards from a card supply. The compartments may be moved relative to the card supply, preferably in two different directions, such as up and down or clockwise and counterclockwise. The card handling may include shuffling, sorting, validation, and other playing card processes.

55 Claims, 5 Drawing Sheets

COLLATING AND SORTING APPARATUS

RELATED APPLICATIONS

This application is a continuation-in-part application of U.S. patent application Ser. No. 09/380,943 filed Sep. 13, 1999, (now U.S. Pat. No. 6,267,248, issued Jul. 31, 2001).

FIELD OF THE INVENTION

This invention relates to collation and/or sorting of groups of articles. In particular, this invention relates to shuffling and sorting apparatus for providing randomly collated groups of articles and/or collated groups of articles according to a predetermined order.

This invention can be utilized to collate and sort groups of articles that have distinguishing characteristics that can be machine identified. However it has particular relevance to shuffling and sorting playing cards and reference will be made hereinafter to such application by way of illustration of the invention.

BACKGROUND OF THE INVENTION

In the gaming industry many packs of cards are utilized and it is necessary to shuffle one or more decks of cards for game use and/or after each game to sort the cards into one or more packs for re-use either in a specific order or at least into a pack of cards which is complete. At present this is achieved manually.

SUMMARY OF THE INVENTION

This invention aims to provide a collation and/or sorting apparatus that will operate efficiently and accurately.

With the foregoing in view, this invention in one aspect resides broadly in collation and/or sorting apparatus including:

- sensor means to identify articles for collation and/or sorting;
- feed means for feeding said articles sequentially past the sensor means;
- storing means in which articles may be collated in groups in a desired order;
- selectively programmable computer means coupled to said sensor means and to said storing means to assemble in said storing means groups of articles in a desired order;
- delivery means for selectively delivering the individual articles into the storing means, and
- collector means for collecting collated groups of articles.

The sensor means may include means to identify the presence of an article. Suitably the sensor means includes means to identify one or more physical attributes of an article. Preferably the sensor means includes means to identify indicia on a surface of an article.

The desired order may be a specific order of a set of articles, such as a deck of cards to be sorted into its original pack order, or it may be a random order into which a complete set of articles is delivered from a plurality of sets of randomly arranged articles. For example the desired order may be a complete pack of playing cards sorted from holding means which holds a plurality of randomly oriented cards forming a plurality of packs of cards. This may be achieved by identifying the individual cards by optical readers, scanners or any other means and then under control of a computer means such as a micro-processor, placing an identified card into a specific collector means to ensure delivery of complete decks of cards in the desired order. The random number generator is used to place individual cards into random positions to ensure random delivery of one to eight or more decks of cards. In one aspect the apparatus is adapted to provide one or more shuffled packs of cards, such as eight packs for the game of baccarat.

The storing means may have individual storing spaces for each respective article to be provided as the collated and/or sorted stack of articles. In such arrangement the delivery means delivers identified articles to the respective storing spaces. This may be achieved by arranging the delivery means with travel means movable along a plurality of axes such as laterally to a column of individual storing spaces and vertically along the column.

In one example of the invention, the storing means is arranged as one or more rotatable storage magazines and the delivery means includes a delivery carriage movable to a respective magazine and drive means for rotating the magazine to operatively align a respective storing space with the delivery carriage.

The collector means may be arranged to receive articles from the storing means as a collated group of articles. For example the storing means may simultaneously release all the articles therein into the collector means that may be a confining chute in which the articles settle as a group. Preferably however the collector means operates after a complete set of articles has been collated in the storing means and sequentially feeds the sorted articles into one or more discrete groups.

The sensor means may be any suitable means for identifying a physical characteristic of the articles to be sorted or it may comprise sensor means for detecting and/or interpreting electromagnetic signals reflected and/or transmitted by an article. An example of one suitable sensor means includes a video camera, such as an EverFocus Model #EB100/E-6, available from EverFocus Electronics Corp., 2445 Huntington Drive, San Marino, Calif. 91108.

One form of the invention is provided as a sorting apparatus for providing a pack of playing cards arranged in original deck order and includes:

- a sensor that is able to identify the suit and value of individual cards;
- a feeder or feed means for feeding the said cards sequentially past the sensor means;
- a storage element or storing means having individual storing spaces for each respective card of a deck of cards;
- selectively programmable computer or artificial intelligence device coupled to the sensor and the storing means to assemble in the storing means individual cards comprising a complete deck or respective decks of cards;
- delivery means for delivering the identified cards or collated decks thereof to preselected individual storing spaces, and
- collector means for collecting one or more decks of cards.

Another form of the invention comprises a card shuffling device to randomly shuffle one or more decks of cards.

Preferably the storing means is arranged as one or more rotatable magazines and the delivery means includes a delivery carriage which receives identified cards from the feeder and is movable along a horizontal drive path in front of a plurality of magazines arranged co-axially and with their common axis parallel to the drive path and which are rotatable together or independently by the computer means to operatively align a respective storing space with the delivery carriage.

The respective storing spaces may include retention means adapted to captively hold a delivered card therein.

The retention means may comprise a vacuum clamping means but preferably the magazine is formed as a quadrant having a lower shroud that prevents dislodgement of the cards from the storing spaces when in an inverted position.

After collation of one or more decks, the or each magazine may be rotated to sequentially engage retained cards with conveying means which conveys collated decks of cards which sequentially come into engagement therewith to a collector means.

BRIEF DESCRIPTION OF THE DRAWINGS

In order that this invention may be more readily understood and put into practical effect, reference will be made to accompanying drawings which illustrate schematically one embodiment of playing card sorting and or shuffling apparatus, wherein.

DETAILED DESCRIPTION OF THE DRAWINGS

Figure 1:
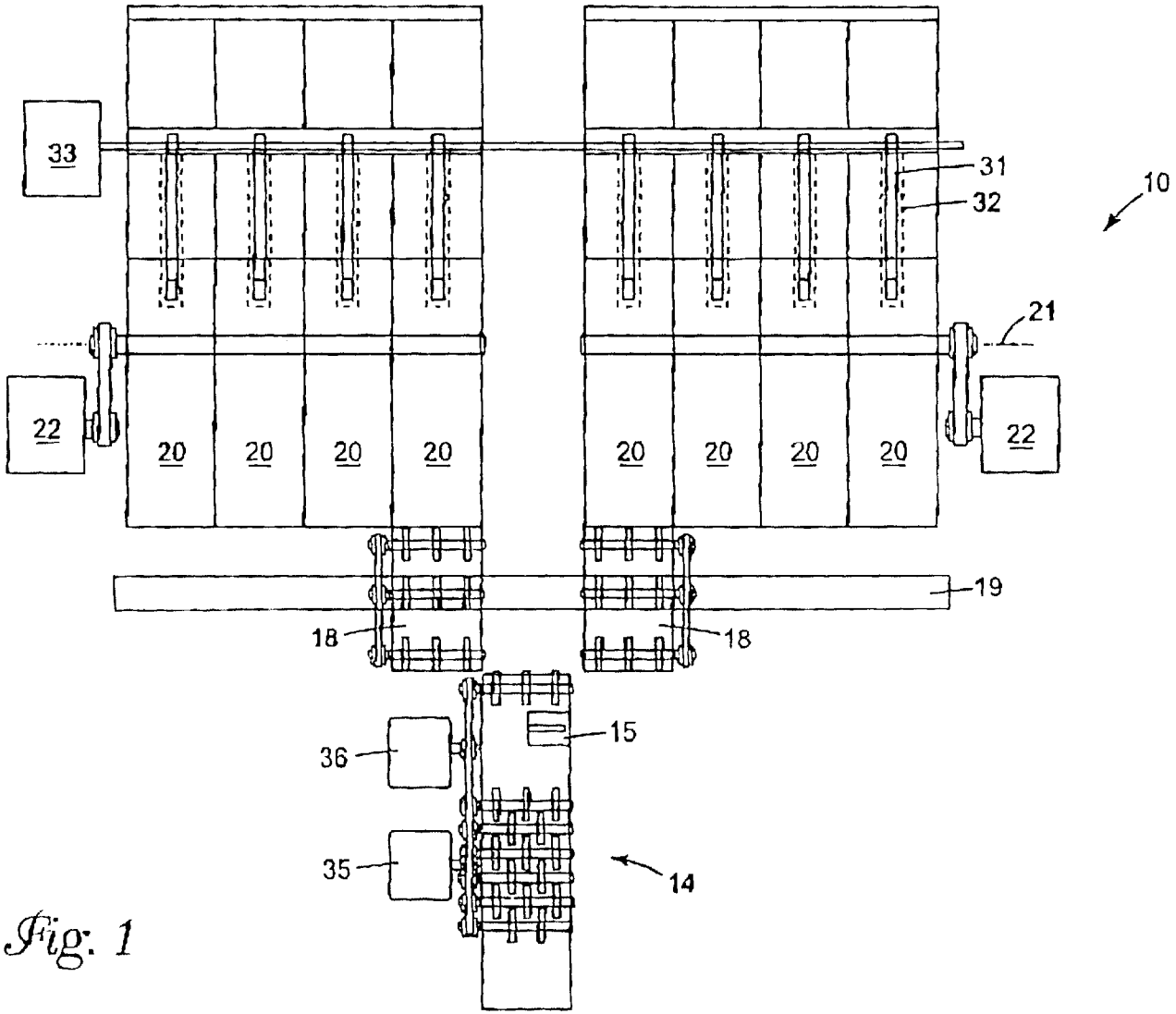
FIG. 1 is a plan view of the apparatus.

The collating apparatus 10 for providing sorted and/or shuffled decks of playing cards from a stack of cards 11 includes holding means 12 for holding the cards in a vertical column 13 above card feeder 14 which feeds the lowermost card of the stack past the sensor 15. The sensor is coupled to a microprocessor 16 to record either the presence of a card and/or the identity of a card by its suit and value. An example of a suitable sensor is a video camera and associated software used to "train" the sensor to sense the rank and suit of a deck of cards. One such device is an EverFocus Model #EB100/E-6, available from EverFocus Electronics Corp., 2445 Huntington Drive, San Marino, Calif. 91108. Microprocessor 16 is also coupled to drive motors 35, 36 of feed means 14, respective drive means (not shown) for transverse movement of each carriage 18, card transport drives 37 associated with carriages 18, magazine drives 22 and drive 33 associated with unloading conveyors 31 for selective coordinated operation to collate packs of shuffled or sorted cards.

In one example of the invention, the feeder 14 delivers each card past the sensor 15 to a selected one of a pair of delivery carriages 18. Each delivery carriage 18 is movable along a common horizontal track 19, transverse to the direction of movement of the cards from the feeder 14, and disposed in front of a plurality of rotatable card magazines 20 arranged co-axially and with their common axis 21 parallel to the drive path 19. In this embodiment there are two banks of four magazines 20 arranged in side-by-side relationship at opposite sides of the feeder 14.

Each bank of magazines 20 is driven by a motor 22 that is, for example, a reversible stepper motor or by a motor drive and brake system to achieve selective incremental rotation of magazines 20 to align openings 23 of card storing spaces 24 with delivery carriages 18 to permit a card to be inserted into a respective storing space 24.

A lower shroud 25 extends beneath the respective banks of magazines 20 to maintain the cards in their respective individual storing spaces 24 and an upper shroud 25*a* terminating in outlet port 27 prevents interference with what otherwise would be exposed storing spaces in the upper part of magazine 20. Shroud 25 extends from the delivery carriages to an associated collecting tray 26 adapted to hold respective card packs. In an alternative embodiment, cards are held in the storing spaces with leaf springs.

As illustrated, there are fifty-six individual storing spaces 24 arranged in an upper sector of the magazine and these radiate outwardly from the axis 21 and fill the space between the outlet port 27, adjacent an unloading conveyor 31, and the output of the delivery carriages 18.

Thus the drive motor 22 may be actuated to position any one of the fifty-six individual storing spaces 24 in operative alignment with the output of delivery carriages 18 while maintaining the rearmost storing space 24 clear of the unloading conveyor 31.

Individual motors 35 and 36 control the feeding of the cards from the column 13 and from the field of sensor 15 and further motors 37 on respective delivery carriages 18 to control movement of the cards thereon into the storage spaces 24. A further motor, not illustrated, controls the movement of each delivery carriage 18 and may be a motor driving a transverse screw shaft coupled to the carriages or a belt drive or other means of driving to control their transverse travel.

In a sorting mode, microprocessor or like programmable control means 16 operates to feed cards from the column 13 sequentially past the sensor 15 which identifies each individual card and commits it to memory with an identification such as a number which corresponds to the sequentially identified storage spaces 24 of a particular magazine 20. More than one deck of cards can be identified and the program will select between those decks when sorting. Thus, when the cards are next fed from the column 13, they will be recognized and fed to a corresponding storage space 24 in a respective magazine 20.

Once a storage space 24 is filled the next card so identified will be fed to an allocated storage space 24 in the same magazine unless a card of identical suit and value previously has been identified in which case that card is allocated to a respective storage space 24 in one of the other magazines 20. This process is repeated until all cards have been sorted and stored.

Thereafter, the magazines are rotated counterclockwise, as shown, towards the unloading conveyors 31 driven in unison by motor 33 until respective conveyors 31 are contacted by the first card in each magazine 20 which card thus will be discharged to the collector tray 26. Unloading conveyors 31 are narrow belts aligned with slotted apertures 32 extending radially of the respective radial walls forming storing spaces 24. The further cards in each magazine will then be sequentially discharged to the collector tray 26 to form packs of sorted cards.

If at the end of sorting any deck of cards is incomplete or over supplied a warning signal will be actuated in association with that deck to indicate the incomplete or oversupplied stack of cards. By actuating an LCD or LED display 28 this will indicate which card is missing or over supplied and will also then indicate any other deck that is incomplete or over supplied. The LCD or LED display 28 may, if required indicate the magazine location in which a card is undersupplied or oversupplied to form a complete deck. Thus, the device of the present invention is capable of accounting for all cards, and for producing an error signal when there are too few or too many cards. The device may also be equipped with a display that provides a visual indication of the particular cards missing or extra cards present, or the total card count.

Figure 3:
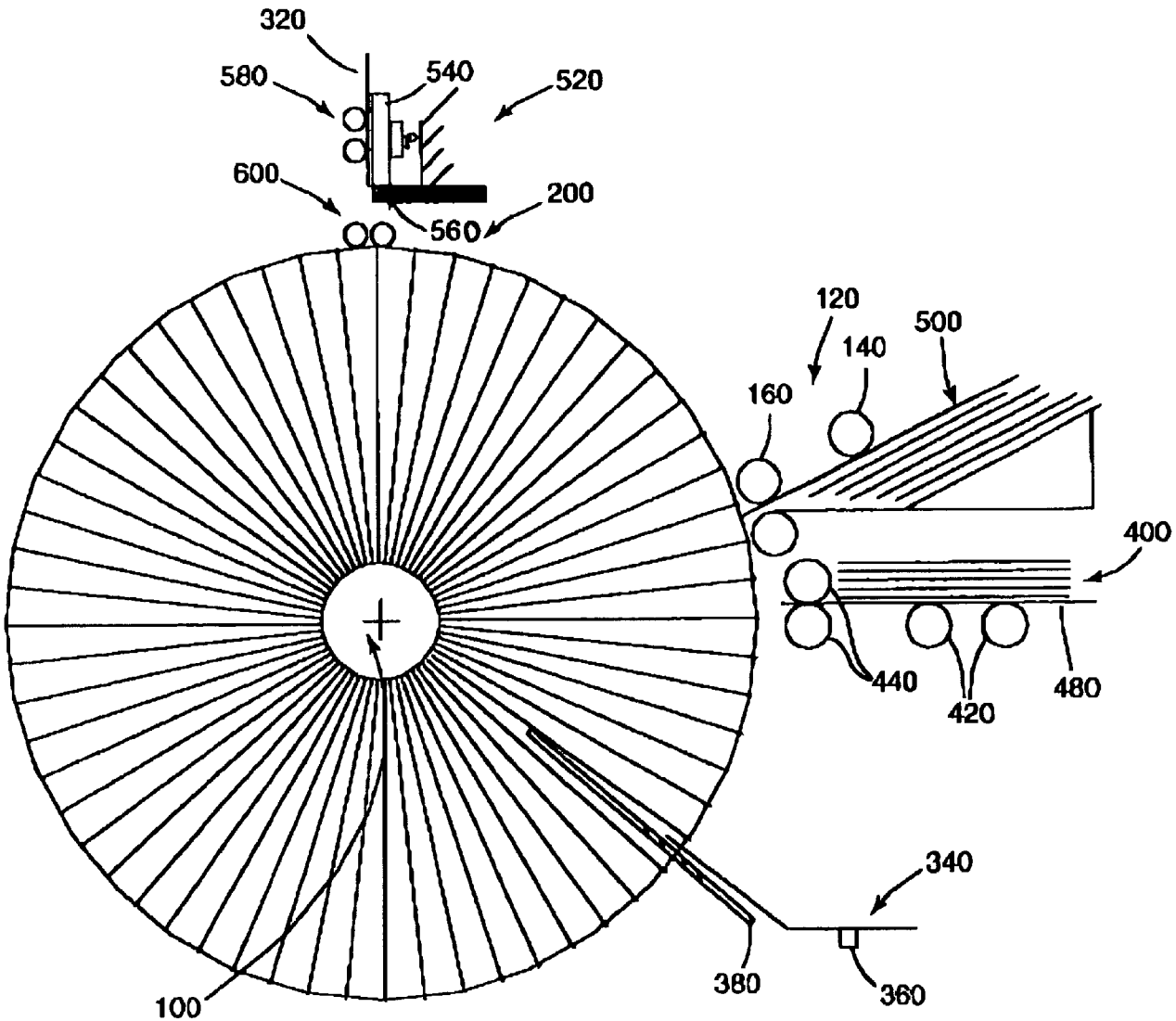
FIG. 3 is a side view of an alternative apparatus of the invention.

An alternative description of the invention is shown in FIG. 3 and is a plurality of card receiving compartments arranged radially about a horizontal rotational axis 100. The rotational axis may be driven by a drive mechanism such as a stepper motor, or by another suitable driving device such as a gear motor, motor or the like.

The microprocessor instructs the driving mechanism to align the selected card-receiving compartment with the feed mechanism 120. As described in the first embodiment. The feed mechanism in this example of the invention removes an upper card from the stack by means of a pick off roller 140. Roller 140 is either driven intermittently, or is equipped with a clutch mechanism that eliminates drag on the card being fed once the fed card comes into contact with speed up roller pair 160.

Figure 4:
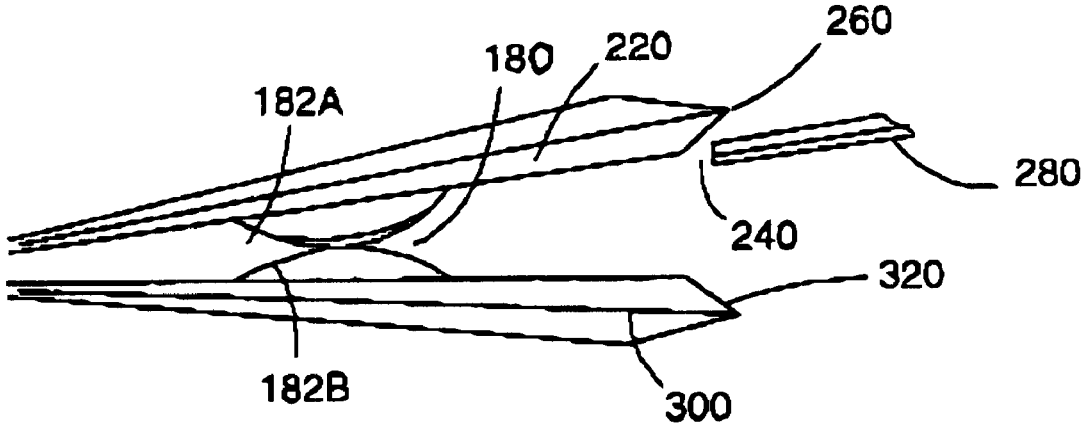
FIG. 4 is a side exploded view of a chamber of the apparatus of FIG. 3.

In one example of the invention, each card receiving compartment is capable of receiving cards in at least two separate locations, as can best be seen by referring to FIG. 4. FIG. 4 shows an exploded view of a single compartment 180, the compartment being representative of at least some of the compartments in the carousel 200. Leaf springs 182A and B are provided to retain the cards in the compartment during rotation. Other retention means are contemplated, such as by means of vacuum, etc. An upper divider 220 has a first card diverting surface 240 which when contacted by a leading edge 260 of a card 280, drives the card onto the top of any cards that might already be present in the compartment. Similarly, a lower divider 300 includes a second card diverting surface 320 capable of diverting a newly fed card underneath any card or cards that might already be present in the compartment. By providing two ways in which to insert a card into a particular compartment, more random shuffling is accomplished with fewer compartments.

If the random groups of cards are recombined in the discharge tray 340 to form a shuffled deck or decks of cards, it is desirable to provide compartments with two feeding locations. When the device is used to deliver smaller groups of cards, such as randomized hands, it is not essential to provide two ways to insert the cards into a single compartment.

In one example of the invention, there are 38 compartments, nineteen adjacent compartments which receive cards to be shuffled from a first deck, and the other nineteen adjacent compartments which unload cards that have been formed into randomly arranged groups of cards.

The carousel 200 rotates in two directions during shuffling, but in one embodiment only loads cards into ½ of the carousel. The other half is used to eject cards out of the carousel. In this embodiment, up to two decks of cards are held in the carousel at one time. One deck is being dispensed, while the other deck is being fed. In another embodiment, only one deck is held, and fewer compartments, i.e., as few as 14 compartments, are needed to accomplish hand formation.

Tray 340, as shown in FIG. 3, is equipped with sensor 360. When a hand of cards is removed from tray 340, sensor 360 sends a signal to the microprocessor to randomly select another compartment to unload.

An unloading device 380 reaches into the rear of the selected compartment and pushes the group of randomly arranged cards into the tray 340. In another embodiment, a pushing device ejects cards from the rear (center) of the carousel. The pushing mechanism is preferably a rack and pinion mechanism, but could also be a gripping assembly, roller assembly or any other structure capable of unloading the selected compartment.

In another example of the invention (also shown in FIG. 3), the cards are stacked and fed by means of a gravity feed device 400 into the shuffler. If the device is capable of placing cards into the top and bottom of one or more of the trays, this device is preferably also capable of temporarily setting the card to be fed aside, either by depositing the card in a separate staging area temporarily, or returning the card to the top of the stack of cards being fed into the device (not shown). Setting aside a card can be accomplished by reversing a direction of rotation of feed rollers 420, and depositing the card into either a separate stack, or returning the cards to the top of the stack of cards being fed. Returning cards to the top can be accomplished by mounting the entire feed device 400 on an elevator, and dropping the feed stack prior to reversing a direction of travel of speed up rollers 440 to return a card to the top of the stack.

This set-aside capability can reduce even further the number of compartments required for random shuffling, as it permits up to three cards to be deposited into each compartment in a predetermined random order at all times. For a fifty-two card deck, eighteen compartments would be required for complete, randomized shuffling. Without providing the set-aside capability or the ability to deliver cards to two distinct positions within a compartment would result in either less efficient shuffling, or would necessitate the need to provide more compartments in which to accomplish random shuffling.

If the particular order in which cards appearing within a hand is unimportant to the game, and the object of the shuffler is to deliver randomly arranged, hands, it would not be necessary to provide the ability to insert cards into top and bottom of a particular compartment. For example, if a player were playing LET IT RIDE™ Stud Poker, and he was dealt a hand of an Ace, 2 and 3, it would make no difference to the player if the hand was formed in any of the following possible orders: A23, A32, 2A3, 23A, 3A2, 32A.

If, however the object of the device is to deliver one or more randomly arranged decks of cards, it is more important to randomly arrange the order of each card within each compartment, as well as between compartments.

Once the cards are randomly distributed to the eighteen (or more) compartments defining one half of the carousel, the shuffler moves into a discharge routine and is ready to deliver randomly arranged hands of cards. Depending upon the type of game being played, the number of players and the number of cards per hand, cards present in some of the compartments may become discarded.

Once the cards are discarded, a separate deck of cards is fed into the device, each card being distributed into the other 19 compartments that were not in use during the previous shuffle.

It might be desirable to form one or more compartments capable of receiving a larger number of cards than the remaining compartments to increase the speed of inserting discards. For example, it might be desirable to form a carousel with 28 compartments, 14 devoted to each deck of cards, with 13 hand forming compartments and a single large discard compartment. Reducing the number of compartments reduces the cost of the device, reduces service issues and speeds up the game.

The feed mechanism 120 in the first example of the invention is advantageously positioned in the "front" of the shuffler, that is, the side of the shuffler that ejects the cards for use by the dealer. By positioning the feed mechanism 120 to the right of vertical axis 320 as shown in FIG. 3, cards may be fed into the device with their face sides down, revealing no information the player or potential card cheats might find useful. It is desirable to feed cards from the front end for a variety of reasons. First, it is easier for the dealer to return cards out of play into the front end of the machine, eliminating the need to lift the cards over the top of the shuffler. Second, there is a perceived value in seeing the faces of discarded cards being fed into the shuffler. Third, loading into the front of the device avoids muscle strain and awkward motion on the part of the dealer.

Since it is always most desirable to discard cards face down into discard tray 340, it is desirable to orient the cards in a way that causes those same cards to be delivered face down as a randomly arranged hand or deck of cards.

If the cards are fed by a gravity feed system (feed system 400), cards should be fed horizontally along path 480, and discard tray 340 should be located beneath path 480, but contained within the same 180 degree arc with respect to vertical axis 320.

If cards are fed by means of a pick off roller assembly 120, then the path 500 along which cards are fed should be positioned somewhere between the vertical axis 320 and horizontal path 480.

In yet another type of feed mechanism shown generally as feed system 520, a group of card 540 rest upon horizontal support 560, and are moved into compartments substantially one at a time by means of pick off rollers 580, advancing through speed up roller set 600. In the third type of feed mechanism the card feeder is located in the highest position that prevents players from viewing card faces. The card-contacting pick off rollers 580 has a card back facing area A, and its card front adjacent to the next card in the stack 540.

It will be seen that the illustrated apparatus may have eight or more or less magazines arranged in groups of four or more or less with common actuation of the unloading conveyor and separate operation of the motors that control their pivotal position.

Figure 2:
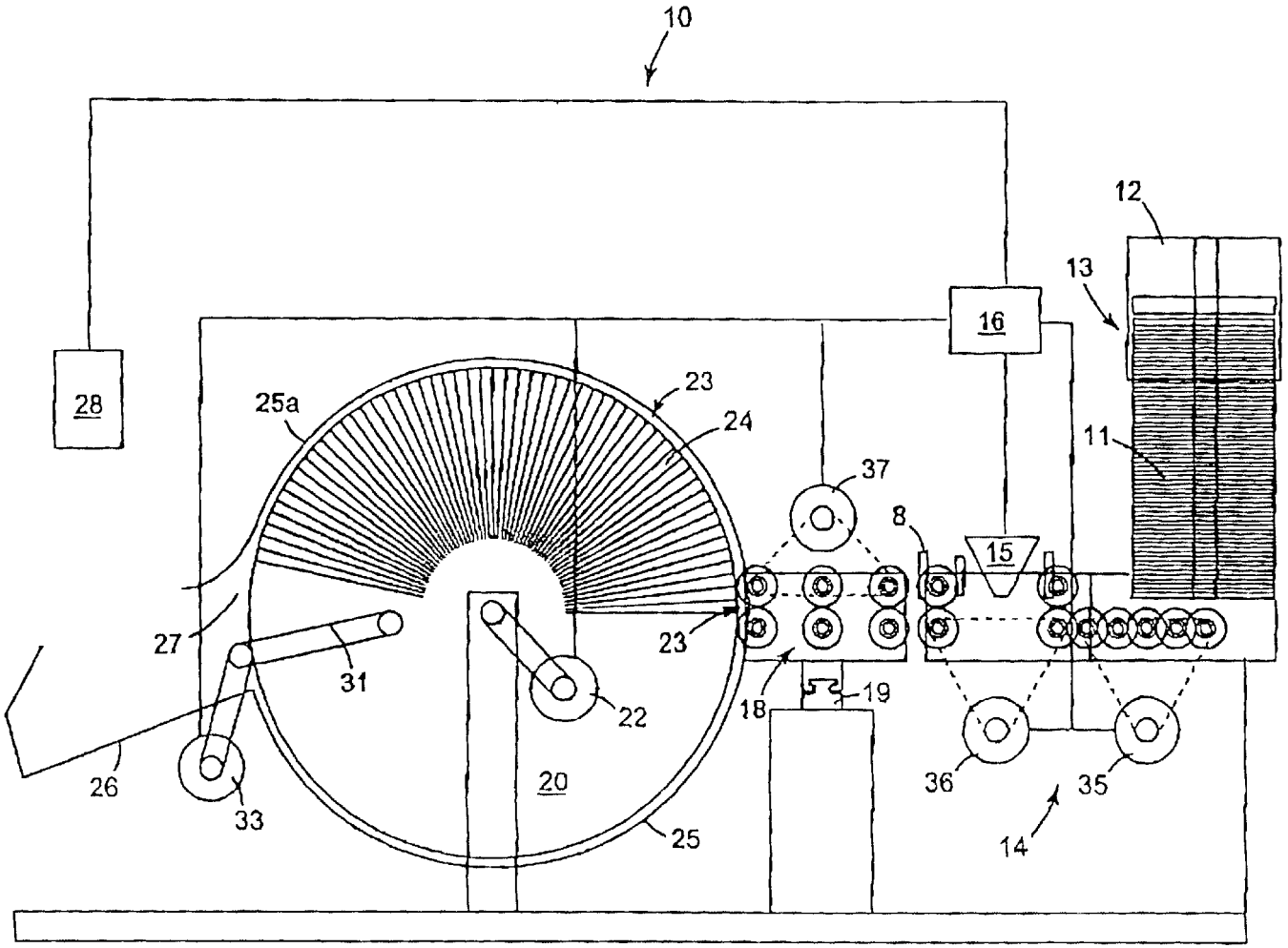
FIG. 2 is a typical sectional view of the apparatus.

In the first example of the invention, when in a shuffling mode for a single pack of cards, sensor 15 (FIG. 2) may or may not be actuated to detect the suit and value of each card. If it is not required to determine the integrity of a pack of cards other than completeness by counting the number of cards, sensor 15 may be actuable to detect only the presence of a card as it passes from feeding means 14 to delivery carriage 18.

As each card is passed beneath sensor 15 its presence is detected and microprocessor 16, using a random number generator, randomly allocates that card to a predetermined one of the fifty-six storage spaces 24 of magazine 20. Microprocessor 16 then controls drive motors 36, 37 and 22 to effect delivery of the card into the randomly predetermined storage space 24.

When the magazine is full and up to fifty six cards have been accounted for, magazine 20 is rotated anticlockwise to permit conveyor 31 to discharge a pack of randomly ordered or "shuffled" cards into collector tray 26.

On the other hand, if a multiplicity of decks is to be shuffled for re-use in a game such as baccarat employing like decks of shuffled cards, it may be important to produce eight individually shuffled decks and/or to determine whether cards have been removed or added to the eight deck stack of cards retrieved from the playing table.

In this case sensor 15 would be operated to determine not only the presence of a card on feed means 14 but also the suit and value of each card to enable loading of the eight magazines each with a randomly ordered or shuffled deck of cards that is otherwise complete.

It will of course be realized that while the above has been given by way of illustrative example of this invention, all such and other modifications and variations hereto, as would be apparent to persons skilled in the art, are deemed to fall within the broad scope and ambit of this invention as is herein set forth.

For example a reject mechanism 8 may be associated with the sensor 15 to cause duplicate or oversupplied cards to be rejected before delivery by the delivery means 18 to the magazine 20. The reject mechanism 8 may comprise an electromechanical device or air blast means coupled to a microprocessor 16.

The rotatable magazine 20 may be substituted for by a vertically displaceable magazine or any other storage device having a plurality of storage spaces to receive individual cards. Similarly for other applications the holding means 12 and feeding means 14 may be replaced by a rotary turntable having a selectively actuable finger guide to remove articles from the turntable.

It readily will be apparent to a skilled addressee that the apparatus according to the invention will have an application in the collation and packaging of cards during their manufacture to ensure the integrity of each set of cards produced.

Equally, it readily will be apparent to a skilled addressee that the invention, with suitable modifications, will have wide application in fields where sets of articles are to be collated and bundled in a predetermined order or in a random order or otherwise where the grouping or collation of articles by number and/or order is essential.

Such applications may include collation of book pages in the correct order with a mixture of black and white and colored pages from different printing presses; packaging of mixed sets of food items i.e., breakfast cereal; dispensing and packaging of mixtures of pills for patients on a daily or weekly basis; sorting and packaging of eggs or fruit by size and/or color; sorting and collation of mail by zip code; sorting and collation of bank checks by payee, payer or bank; collation and sorting of bank notes by denomination, condition or integrity or even sorting and collation of doctors prescription forms to monitor information on patients, drug prescribed, pharmacy or prescribing doctor.

The present invention is able to collate and/or sort articles by physical attributes such as size, color, shape, mass (e.g., by load cell or the like) or surface indicia or any combination thereof.

The invention includes, for example variations including an apparatus for automatically shuffling cards, comprising:

- a card feed station;
- a multi-compartment mixing chamber, the mixing chamber having a plurality of card receiving compartments extending radially from a central rotational axis;
- a horizontally disposed drive shaft;
- a drive mechanism coupled to the drive shaft controlling rotation of the mixing chamber;
- a microprocessor for randomly assigning cards being fed into the card receiving compartments and for controlling the operation of the card shuffler;
- a card delivery tray for receiving groups of cards removed from the card receiving compartments, wherein the card delivery tray is positioned such that cards are delivered into the card receiving tray face-down;
- a card feed mechanism that feeds cards individually from the card feed station into a card receiving compartment, wherein the card feed mechanism is positioned such that only card backs are in view of players and or the dealer.

The apparatus may have a sensor is present to indicate the movement or position of cards. The sensor may include means to identify one or more physical attributes of an article. The sensor may include means to identify indicia on a surface of an article. The invention also describes an apparatus where the sensor means comprises an optical reader. The apparatus may have the feed means adapted to withdraw individual cards from a group of cards and to feed the individual cards sequentially past the sensor means.

Another apparatus according to the invention is for arranging playing cards in a desired order, the apparatus including:

a housing;

a sensor to sense playing cards prior to arranging;

a playing card feeder for feeding playing cards sequentially past the sensor;

a storage assembly having a plurality of storage locations in which playing cards may be arranged in groups in a desired order, wherein the storage assembly is adapted for relative vertical movement with respect to the playing card feeder in at least two directions during shuffling;

a selectively programmable computer coupled to the sensor and to the storage assembly to assemble in the storage assembly groups of playing cards in a desired order;

a delivery mechanism for selectively delivering playing cards located in selected storage locations of the storage assembly; and a collector for collecting arranged groups of playing cards.

The apparatus may have the collector include a playing card extractor to assist in extraction of playing cards from respective individual storage spaces.

A method may be practiced with the apparatus for sorting a pack of playing cards by feeding individual cards from a card feeder past a sensor to determine suit and value of individual cards and transmitting sensor signal data to a computer;

computing sensor signal data for each respective card and allocating thereto a predetermined value corresponding to the order of a particular card in a sorted pack;

delivering sensed cards to a collator having an individual storage space allocated to a card of predetermined suit and value, the collator moving relatively vertically with respect to the card feeder;

indexing the collator with a delivery mechanism to deliver each sensed card to a respective storage space of the collator; and sequentially removing the cards from the collator to form a sorted pack of playing cards.

Figure 5:
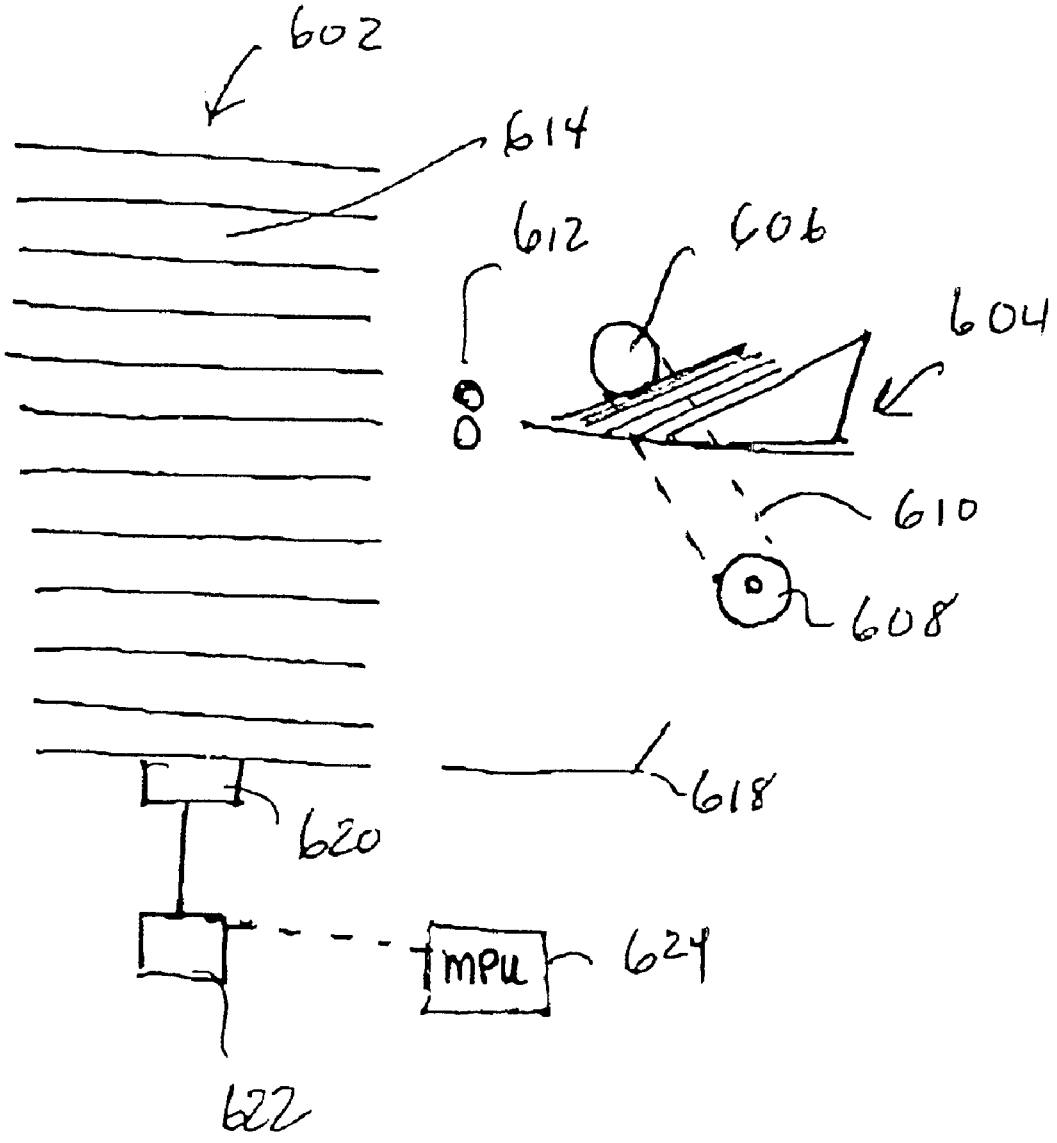
FIG. 5 shows another example of the invention.

A method of shuffling a pack of cards is described comprising:

feeding cards by means of a card delivery mechanism individually past a sensor to determine the presence of each card and transmitting sensor signal data to a computer;

computing sensor signal data for each respective card and allocating thereto a value generated by a random number generator corresponding to a storage space in a collator;

delivering sensed cards to a collator having a plurality of storage spaces;

indexing said collator with a card delivery mechanism to deliver each card to the corresponding storage space of the collator, wherein relative motion between the collator and card feeder is both vertical and in at least two directions during shuffling; and collecting cards from the collator to form a randomly ordered pack of playing cards. The storage assembly may comprise a stack that moves vertically with respect to the delivery mechanism as shown in FIG. 5. FIG. 5 shows a vertical mixing stack 602, with a feed mechanism 604 including a feed roller 606 with a frictional outer surface, driven by means of a motor 608 and continuous belt 610. Cards are fed individually through speed-up rollers 612 into a randomly selected compartment 614 during shuffling. Cards are removed as a group by means of a rack and pinion (not shown) into a card delivery tray 618. The mixing stack 602 moves by means of an elevator 620 in two directions. In one example of the invention, stepper motor 622 is used to move the elevator. An MPU 624 controls the operation of the device. The collator may move relatively in two different directions during a period when the sorted pack of playing cards is formed.

The storage assembly preferably comprises at least eight adjacent magazines that move vertically with respect to the delivery mechanism and the feeder comprises a conveyor. In the practice of the method, the desired order preferably is a random order of cards or a pre-selected order of cards. The sensor may sense only the presence of a card and/or the value of the card and the sensor may be an optical reader. The apparatus may have the storage assembly as a vertical rack or a carousel. The feeder may be capable of withdrawing individual playing cards from the group of playing cards and feed individual playing cards sequentially past the sensor.

Another aspect of the invention is for a card sorting device, comprising:

a housing:

an infeed receptacle for accepting cards to be fed;

a card moving mechanism for moving cards from the infeed receptacle to a storage device;

a storage device comprising a vertical stack of a plurality of compartments for receiving cards to be sorted;

a mechanism for moving the storage device relative to the card moving mechanism to permit card placement in different compartments in the card storage device;

a card unloading device for removing cards from the compartments in the card storage device; and a selectively programmable microprocessor for selecting a compartment in the card storage device to receive each card being moved and for changing a direction of movement of the storage device during shuffling. The card sorting device may have a sensor for sensing cards prior to insertion into compartments in the storage device, and again the device may be a stack of compartments or a carousel. Each compartment may receive only a single card or at least some compartments in the card storage device receives more than one card. The sensor may include means to identify the presence of a playing card or be adapted to identify one or more physical attributes of a playing card, for example, adapted to identify indicia on a playing card. In the apparatus, the feeder may be adapted to withdraw individual playing cards from a group of playing cards and feed said individual playing cards sequentially past the sensor. The feeder may include a conveyor, and the storage assembly comprises one or more storage magazines each having a plurality of storage spaces. One or more storage magazines may each include a predetermined number of individual storage spaces corresponding to the number of playing cards in a pack, and also individual storage spaces may bee selectively indexable with said delivery system.

The delivery assembly may be displaceable between adjacent storage magazines and the apparatus may include at least two delivery assemblies. The collector may be adapted to collect a collated group of playing cards, and the sensor may be designed to detect electromagnetic signals reflected and/or transmitted by a playing card. The apparatus may have the programmable computer include data memory and data storage capacity to store data relating to each individual playing card sensed by the sensor. The apparatus may include a random number generator for randomly allocating playing cards to said storage assembly, and the pack of cards comprises one or more decks of cards. The sensor may be adapted to determine the suit and/or value of individual cards.

An alternative aspect of the invention would be a card handling (shuffling, counting, sorting, hand-forming, etc.) device, comprising:

a housing having a forward side and a rearward side:

an infeed receptacle on the forward side of the housing for accepting cards to be fed;

a card moving mechanism for moving cards from the infeed receptacle to a storage device;

a storage device comprising a vertical stack of a plurality of compartments for receiving cards, a mechanism for moving the storage device relative to the card moving mechanism to permit card placement in different compartments in the card storage device;

a card unloading device for removing cards from the compartments in the card storage device from the forward side of the housing; and a selectively programmable microprocessor for selecting a compartment in the card storage device to receive each card being moved and for changing a direction of movement of the storage device during shuffling.

The card handling device may have the vertical stack of compartments for receiving cards move vertically relative to the card moving mechanism.

Another aspect of the invention is for a card handling device, comprising:

a housing having a forward side and a rearward side:

an infeed receptacle on the forward side of the housing for accepting cards to be fed;

a card moving mechanism for moving cards from the infeed receptacle to a storage device;

a storage device comprising a carousel of a plurality of compartments for receiving cards;

a mechanism for moving the storage device relative to the card moving mechanism to permit card placement in different compartments in the card storage device;

a card unloading device for removing cards from the compartments in the card storage device from the forward side of the housing; and a selectively programmable microprocessor for selecting a compartment in the card storage device to receive each card being moved and for changing a direction of movement of the storage device during shuffling.

The card handling apparatus may have the change of directions be a change between clockwise and counterclockwise movement of the carousel.

What is claimed:

1. An apparatus for automatically shuffling cards, comprising:

a card feed station;

a multi-compartment mixing chamber, the mixing chamber having a plurality of card receiving compartments extending radially from a ventral rotational axis;

a horizontally disposed drive shaft;

a drive mechanism coupled to the drive shaft controlling rotation of the mixing chamber;

a microprocessor for randomly assigning cards being fed into the card receiving compartments and for controlling the operation of the card shuffler;

a card delivery tray for receiving groups of cards radially removed from the card receiving compartments, wherein the card delivery tray is positioned such that cards are delivered into the card receiving tray face-down;

a card feed mechanism that radially feeds cards individually from the card feed station into a card receiving compartment, wherein the card feed mechanism is positioned such that only card backs are in view of players and or the dealer.

2. The apparatus of claim 1 wherein a sensor is present to indicate the movement or position of cards.

3. An apparatus according to claim 2 wherein the sensor means includes means to identify one or more physical attributes of an article.

4. An apparatus according to claim 2 wherein the sensor means includes means to identify indicia on a surface of an article.

5. An apparatus as claimed in claim 4 wherein the sensor means is selected from the group consisting of an optical reader and a video camera.

6. An apparatus according to claim 1 wherein the feed means is adapted to withdraw individual cards from a group of cards and to feed the individual cards sequentially past the sensor means.

7. The apparatus of claim 1 wherein the storage assembly is a carousel.

8. An apparatus for arranging playing cards in a desired order, said apparatus including:

a housing;

a sensor to sense playing cards prior to arranging;

a playing card feeder for feeding said playing cards sequentially past the sensor;

a storage assembly having a plurality of storage locations in which playing cards may be arranged in groups in a desired order, wherein the storage assembly is adapted for relative vertical movement with respect to the playing card feeder in at least two directions during shuffling;

a selectively programmable computer coupled to said sensor and to said storage assembly to assemble in said storage assembly groups of playing cards in a desired order;

a delivery mechanism for selectively delivering playing cards located in selected storage locations of the storage assembly; and a collector for collecting arranged groups of playing cards.

9. An apparatus as claimed in claim 8 wherein the collector includes a playing card extractor to assist in extraction of playing cards from respective individual storage spaces.

10. The apparatus of claim 8 wherein the storage assembly comprises a stack that moves vertically with respect to the delivery mechanism.

11. The apparatus of claim 8 wherein the storage assembly comprises at least eight adjacent magazines that move vertically with respect to the delivery mechanism.

12. The apparatus of claim 8, wherein the feeder comprises a conveyor.

13. The apparatus of claim 8 wherein the desired order is a random order of cards.

14. The apparatus of claim 8 wherein the desired order is a preselected order of cards.

15. The apparatus of claim 8 wherein the sensor senses only the presence of a card.

16. The apparatus of claim 8 wherein the sensor senses the value of the card.

17. The apparatus of claim 8 wherein the sensor is an optical reader.

18. The apparatus of claim 17 wherein the storage assembly is a vertical rack.

19. The apparatus of claim 8, wherein the feeder is capable of withdrawing individual playing cards from the group of playing cards and feed individual playing cards sequentially past the sensor.

20. A method for sorting a pack of playing cards, said method comprising:

feeding individual cards from a card feeder past a sensor to determine suit and value of individual cards and transmitting sensor signal data to a computer;

computing sensor signal data for each respective card and allocating thereto a predetermined value corresponding to the order of a particular card in a sorted pack;

delivering sensed cards to a collator having an individual storage space allocated to a card of predetermined suit and value, the collator moving relatively vertically with respect to the card feeder;

indexing said collator with a delivery mechanism to deliver each said sensed card to a respective storage space of said collator; and sequentially removing said cards from said collator to form a sorted pack of playing cards.

21. The method of claim 20 wherein the collator moves relatively in two different directions during a period when the sorted pack of playing cards is formed.

22. A method of shuffling a pack of cards, said method comprising the steps of:

feeding cards by means of a card delivery mechanism individually past a sensor to determine the presence of each card and transmitting sensor signal data to a computer;

computing sensor signal data for each respective card and allocating thereto a value generated by a random number generator corresponding to a storage space in a collator;

delivering sensed cards to a collator having a plurality of storage spaces;

indexing said collator with a card delivery mechanism to deliver each said card to the corresponding storage space of said collator, wherein relative motion between the collator and card feeder is both vertical and in at least two directions during shuffling; and collecting cards from said collator to form a randomly ordered pack of playing cards.

23. A card shuffling device, comprising:

a housing;

an infeed receptacle for accepting cards to be fed;

a card moving mechanism for moving cards from the infeed receptacle to a storage device;

a storage device comprising a vertical stack of a plurality of compartments for receiving cards to be sorted;

a mechanism for moving the storage device relative to the card moving mechanism to permit card placement in different compartments in the card storage device;

a card unloading device for removing cards from the compartments in the card storage device; and a selectively programmable microprocessor for selecting a compartment in the card storage device to receive each card being moved and for changing a direction of movement of the storage device during shuffling.

24. The card shuffling device of claim 23 further comprising a sensor for sensing cards prior to insertion into compartments in the storage device.

25. The card shuffling device of claim 23 wherein the storage device is a stack of compartments.

26. The card shuffling device of claim 23 wherein the storage device is a carousel.

27. The card shuffling device of claim 23 wherein each compartment in the card storage device receives only a single card.

28. The card shuffling device as claimed in claim 27 wherein the sensor is adapted to detect electromagnetic signals reflected and/or transmitted by a playing card.

29. The card shuffling device as claimed in claim 27, wherein the sensor includes means to identify the presence of a playing card.

30. The card shuffling device as claimed in claim 29 wherein the sensor is adapted to identify one or more physical attributes of a playing card.

31. The card shuffling device as claimed in claim 30 wherein the sensor is adapted to identify indicia on a playing card.

32. The card shuffling device as claimed in claim 29 wherein said programmable computing means includes data memory and data storage capacity to store data relating to each individual playing card sensed by the sensor.

33. The card shuffling device as claimed in claim 32 including a random number generator for randomly allocating playing cards to said storage assembly.

34. The card shuffling device as claimed in claim 33 wherein said pack of cards comprises one or more decks of cards.

35. The card shuffling device as claimed in claim 34 wherein said pack comprises one or more decks of cards.

36. The card shuffling device as claimed in claim 35 wherein said sensor is adapted to determine the suit and/or value of individual cards.

37. The card shuffling device of claim 23 wherein at least some compartments in the card storage device receives more than one card.

38. The card shuffling device as claimed in claim 23 wherein the feeder is adapted to withdraw individual playing cards from a group of playing cards and feed said individual playing cards sequentially past the sensor.

39. The card shuffling device as claimed in claim 38 wherein the feeder includes a conveyor.

40. The card shuffling device as claimed in claim 23 wherein the sensor comprises a scanning device.

41. The card shuttling device as claimed in claim 23 wherein the storage assembly comprises one or more storage magazines each having a plurality of storage spaces.

42. The card shuffling device as claimed in claim 41 wherein said one or more storage magazines each include a predetermined number of individual storage spaces corresponding to the number of playing cards in a pack.

43. The card shuffling device as claimed in claim 42 wherein individual storage spaces are selectively indexable with said delivery system.

44. The card shuffling device as claimed in claim 43 storage assembly comprises spaced storage spaces displaceable along an upright axis relative to said delivery mechanism.

45. The card shuffling device as claimed in claim 43 wherein said delivery assembly comprises a conveyor.

46. The card shuffling device as claimed in claim 45 wherein the delivery assembly is displaceable between adjacent storage magazines.

47. The card shuffling device as claimed in claim 46 including at least two delivery assemblies.

48. The card shuffling device as claimed in claim 41 wherein said collector is adapted to collect a collated group of playing cards.

49. A card handling device, comprising:

a housing having a forward side and a rearward side:

an infeed receptacle on the forward side of the housing for accepting cards to be fed;

a card moving mechanism for moving cards from the infeed receptacle to a storage device;

a storage device comprising a vertical stack of a plurality of compartments for receiving cards;

a mechanism for moving the storage device relative to the card moving mechanism to permit card placement in different compartments in the card storage device;

a card unloading device for removing cards from the compartments in the card storage device from the forward side of the housing; and a selectively programmable microprocessor for selecting a compartment in the card storage device to receive each card being moved and for changing a direction of movement of the storage device during shuffling.

50. The card handling device of claim 49 wherein the vertical stack of compartments for receiving cards moves vertically relative to the card moving mechanism.

51. A card handling device, comprising:

a housing having a forward side and a rearward side:

an infeed receptacle on the forward side of the housing for accepting cards to be fed;

a card moving mechanism for moving cards from to infeed receptacle to a storage device;

a storage device comprising a carousel of a plurality of compartments for receiving cards;

a mechanism for moving the storage device relative to the card moving mechanism to permit card placement in different compartments in the card storage device;

a card unloading device for removing cards from the compartments in the card storage device from the forward side of the housing; and a selectively programmable microprocessor for selecting a compartment in the card storage device to receive each card being moved and for changing a direction of movement of the storage device during shuffling.

52. The card handling apparatus of claim 51 wherein the change of directions is a change between clockwise and counterclockwise movement of the carousel.

53. A playing card shuffling device, comprising:

a housing:

an infeed receptacle for accepting cards to be fed;

a card moving mechanism for moving cards from the infeed receptacle to a storage device;

the storage device comprising a vertical stack of a plurality of compartments for receiving cards to be shuffled;

a mechanism for relatively moving the storage device with respect to the card moving mechanism to permit card placement in different compartments in the card storage device;

a card unloading device for removing cards from the compartments in the card storage device to form a random set of cards; and a selectively programmable microprocessor for selecting a compartment in the card storage device to receive each card being moved and for changing a direction of movement of the storage device during shuffling of the cards, the card shuffling device having a sensor for sensing cards prior to insertion into compartments in the storage device.

54. The card shuffling device of claim 53 wherein the sensor identifies the presence of a card and compartments accept more than one card at a time and where a random number generator allocates playing cards to compartments in the card storage device.

55. The card shuffling device of claim 54 wherein the programmable microprocessor includes data memory and data storage capacity to store data relating to each playing card sensed by the sensor.

* * * * *